United States Patent [19]

Black

[11] Patent Number: 4,739,558

[45] Date of Patent: Apr. 26, 1988

[54] LINE DRAWING INSTRUMENT

[76] Inventor: Sydney J. Black, 32 Slalom Drive, Moonstone, Ontario L0K1N0, Canada

[21] Appl. No.: 850,231

[22] Filed: Apr. 10, 1986

[30] Foreign Application Priority Data

Aug. 22, 1985 [CA] Canada ..... 489212

[51] Int. Cl.[4] ..... B43L 13/02

[52] U.S. Cl. ..... 33/42; 33/DIG. 9

[58] Field of Search ..... 33/18, 27.11, 26, 39, 33/41, 42, DIG. 9

[56] References Cited

U.S. PATENT DOCUMENTS 2,509,164 5/1950 Nath ..... 33/41.1
3,465,445 9/1969 Fisher ..... 33/41.1

FOREIGN PATENT DOCUMENTS 1914490 10/1970 Fed. Rep. of Germany ..... 33/42
1090653 4/1955 France ..... 33/41.2
158989 5/1957 Sweden ..... 33/42

*Primary Examiner*—Harry N. Haroian
*Attorney, Agent, or Firm*—Cesari and McKenna

[57] ABSTRACT

A drawing apparatus is disclosed for guiding the continuous drawing of two intersecting lines with interconnecting curved corner portions. The apparatus comprises a set of rulers which intersect one another at a desired angle of 90° or less to define thereby a corner. A guide is provided for guiding the continuous drawing of two intersecting lines with the curved corner. The guide has a base portion with an external edge. An aperture extends through the base and has an interior edge of a shape to define the desired curved shape for the corner. The guide remains stationary in the corner defined by the rulers to cause a drawing instrument to follow the interior surface of the aperture in continuously drawing a curved corner of desired shape from a first line merging into a second intersecting line.

17 Claims, 6 Drawing Sheets

LINE DRAWING INSTRUMENT

FIELD OF THE INVENTION

This invention relates to a drawing apparatus and more particularly, to a drawing apparatus which is used in drawing line borders and the like which have intersecting lines with uniform curved corners.

BACKGROUND OF THE INVENTION

In many types of commercial art used in advertisements, sales brochures and the like, a message or statement may be highlighted with a border. In many situations involving commercial art, hundreds of line borders may be drawn daily in providing the master set-up. These line borders can be done by hand by use of a straight edge and ink pen or pencil and a curved template. However, it is extremely difficult to provide a continuous uniform line in passing from a first line through a rounded corner into a second line of a border. Often times at the speed which is required to turn out many borders per day in commercial art, the lines do not always exactly meet and non-uniformity in the design results. Furthermore, when it is desired to draw several concentric borders consisting of parallel lines with rounded corners at their intersection, it becomes increasingly difficult to provide a uniform attractive configuration.

Many drawing instruments and devices have been developed to provide for the drawing of parallel lines or uniformly spaced curved lines. Most commercial devices require the rotation of a guide device when drawing curved corners which interconnect intersecting lines. Examples of these types of devices are found in U.S. Pat. Nos. 2,509,164, 2,561,585, 3,465,445 and 4,335,515. Normally if a curved corner is desired, then the template which the drawing instrument guide follows has a correspondingly rounded portion in the manner disclosed in U.S. Pat. No. 4,335,515. U.S. Pat. No. 2,509,164 discloses the drawing of rounded corners between intersecting lines. However, the guide must rotate as the drawing instrument draws the rounded corner between the intersecting lines defined by the rulers. A similar device is disclosed in U.S. Pat. No. 3,465,445. The difficulty with the guides rotating during the drawing of corner portions, and for that matter with rotating during other sequences in drawing of lines, is that due to frictional engagement, vibrations can be induced in the drawing instrument resulting in jagged edges for the line and a non-uniform appearance.

Attempts have been made to smooth out the rotation of guide devices, such as disclosed in U.S. Pat. No. 2,782,506 where the drawing instrument is mounted in a bearing device which minimizes the effect of rotation of the device as it follows a guide. However, this arrangement is complex in design and far too involved for the simple technique of drawing line borders. Another device, which may or may not involve rotary heads, is disclosed in U.S. Pat. No. 3,867,761. The templates for guiding the end of the drawing device may be telescoped within a single unit. Depending upon which concentric ring abuts the template, the positioning of the line relative to the template is determined to provide for a multi-line border. However, this system is bulky and difficult to use in maintaining uniform lines because of possible slippage of one or more of the spring loaded concentric rings off of the template.

SUMMARY OF THE INVENTION

According to an aspect of this invention, a drawing apparatus is provided which enables artists to draw a continuous line in the shape of a square, rectangle, triangle or the like where each corner has a desired curved shape. Multiple lines may be drawn to create a desired effect. The apparatus for guiding the continuous drawing of two intersecting lines with interconnecting curved corners comprises a pair of rulers having first and second edges which intersect one another at a desired angle of 90° or less to define thereby a corner. Means for guiding the continuous drawing of the two intersecting lines with a curved corner is provided. The guide means has a base portion with an external edge. An aperture extends through the base and has an interior edge of at least first, second and third guide portions. The first and third guide portions guide the drawing of first and second intersecting lines with the base external edge engaging and moving along respectively the first and second ruler edges. The second guide portion remains stationary with the base external edge abutting simultaneously the first and second ruler edges to cause thereby a drawing instrument to follow the second guide portion in continuously drawing a curved corner of desired shape from a first line merging into a second intersecting line.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
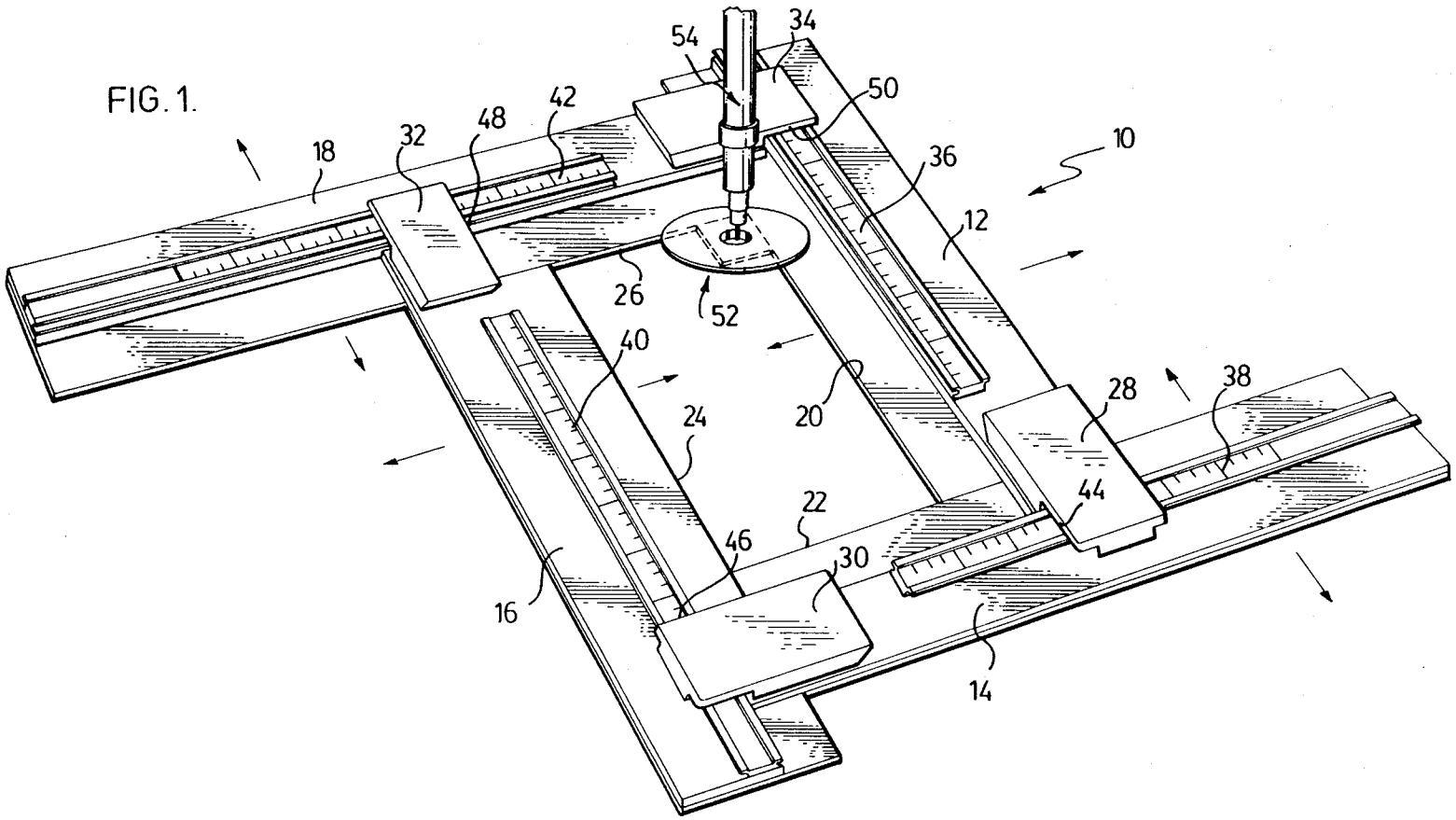
FIG. 1 is a perspective view of the drawing apparatus according to a preferred embodiment of this invention.

The drawing apparatus, according to this invention, provides a reliable device which expedites the drawing of many shapes of borders of individual or parallel lines with a variety of curved corners interconnecting the line. The apparatus 10, as shown in FIG. 1, comprises two pairs of rulers 12, 14, 16 and 18. The rulers have first, second, third and fourth edges designated 20, 22, 24 and 26 respectively. These ruler edges define a rectangular frame. The pairs of rulers are interconnected by connectors 28, 30, 32 and 34 which are releasable. This permits adjustment of the rulers relative to each other in the direction of the arrows indicated to provide for an enlarging or reducing of the size of the rectangular frame. This provides the basis for the size of border line desired in the artistic work. Each ruler includes a scale 36, 38, 40 and 42. Each releasable connector has an indicator edge 44, 46, 48 and 50 for indicating on the respective scale the relative position of one ruler to another. This permits the accurate positioning of the rulers relative to one another to provide desired size of border. The scales may be marked in inches, millimeters or picas in accordance with the particular requirements of the user.

A drawing guide is generally designated 52. The guide is used to guide the continuous drawing of the straight lines about the border as defined by the rectangular frame of the ruler set and also the smoothly curved interconnecting corners in a manner to be described in more detail with respect to FIGS. 2 through 4. The drawing instrument 54 may be of any of the commercial types, such as ink pens or pencils.

By use of the apparatus of FIG. 1, a variety of generally rectangular-shaped borders with rounded corners may be formed. The borders may be of thick and thin lines where different size drawing instruments are used. Furthermore, different size guides may be used to realize various spacing between the parallel lines of the border.

Figure 2:
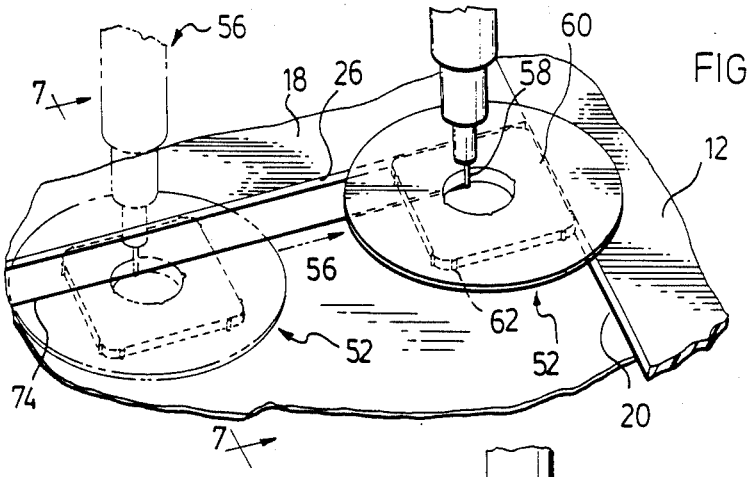
FIGS. 2, 3 and 4 illustrate in sequential perspective views the interaction of the guide of FIG. 1 with the ruler edges in the continuous drawing of two intersecting lines with uniform rounded corner portion.
Figure 5:
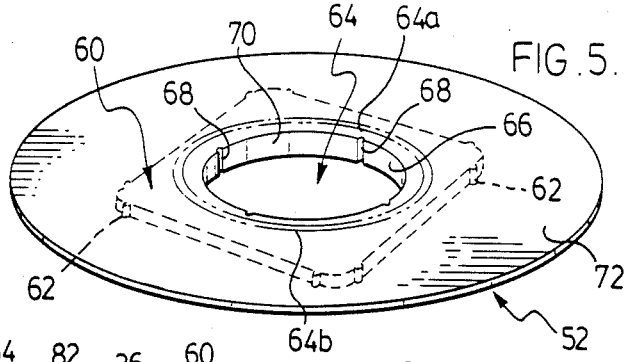
FIG. 5 is a perspective view of the drawing instrument guide.

According to this invention, a smooth, uniform, continuous line can be drawn to provide for a first line which merges smoothly around a curved corner portion into a second intersecting line. As shown in FIG. 2, the guide 52 traverses the fourth edge 26 of ruler 18 in the direction of arrow 56 towards the first edge 20 of ruler 12. The drawing instrument 54 which, according to this embodiment, is an ink pen with a nib 58 of the desired thickness, is positioned within the drawing guide 52. As shown more clearly in FIG. 5, the drawing guide 52 comprises a base portion 60 having an external edge which, according to this embodiment, is square shaped and defined by pads 62 projecting outwardly of the base 60. The pads 62 engage the rule edges in locating the aperture 64 relative to the ruler edge. The aperture 64 includes an internal edge 66 which, according to this embodiment, is circular. The aperture is centered with respect to the base edges defined by the pads 62. It is appreciated that the aperture 64 may be of a variety of configurations to provide any desired shape of curved corner for the intersecting first and second lines of a border which will be appreciated in the subsequent discussion with respect to FIGS. 9 and 10.

The aperture interior edge 66, according to a preferred embodiment, includes an indentation 68 opposite each planar edge of the rectangular-shaped base 60. The indentation 68 serves to locate the drawing instrument in a guide portion of the aperture which is closest to ruler edge to ensure a straight consistent drawing of straight lines along the ruler edges. It is appreciated that the indentation 68 must be very slight in depth so as to not disturb the uniformity in the continuous drawing of the lines, particularly emerging from the straight lines into the curved corners and on into the next intersecting line. It has been found that recesses of a depth of approximately 2/1000 of an inch are suitable in this respect. Thus, the indentations 68 of the guide 52 define first and third guide portions of the aperture which are on each side of a second curved guide portion 70, which defines the shape of the curved corner between the intersecting border lines. With a rectangular ruler frame, the indentations 68 provide four distinct portions on the aperture internal surface 66 which act as guide portions for drawing the corresponding four straight lines of the borders. The intermediate sections between the indentations 68 provide the guides for drawing the curved corners between the straight lines of the four sided border.

The guide 52 further includes a flange 72 which, according to this embodiment, is integral with the base 60. The flange lies on and rides along the respective ruler of the set of FIG. 1 in a manner to be discussed with respect to FIG. 6. The flange 72 may be of various shapes, such as the shown circular shape; however, the flange 72 can also be any of the polygonal shapes. In order to achieve the desired drawing of a plurality of border lines which are uniformly spaced from one another, the guide 52 may be in the form of a set of a plurality of guides each having a different size aperture as indicated by dotted lines **64*a* and 64*b*, etc. According to this embodiment, all apertures are circular, where each guide may have a serially increasing opening size in the base 60, all centered in the square base and thus all apertures having the same centre. This locates the guide portions serially at further distances from the centre of the guide to provide for additional spaced-apart lines in the border without having to enlarge or decrease the size of the rectangular frame defined by the ruler set of FIG. 1**.

The pen nib 58, as shown in FIG. 2, is located in one of the indentations 68 where the pads of the base engage the edge 26 of the ruler 18. As the guide 52 is moved in the direction of arrow 56, a straight line 74 is drawn. Due to the planar edge defined by the base pads, rotation of the base is prevented during the drawing of the intersecting lines and the interconnecting corner portion. Continued movement of the guide 52 positions the pads of the square base simultaneously against edge portions 20 and 26 of rulers 12 and 18, thus locating the guide in the corner of the rectangular frame defined by the rulers. Due to engagement of both edges of the base 60 of the guide 52, with the pen nib 58 located in the position as shown in FIG. 2, further movement of the guide 52 is precluded. Hence the corner of the rulers in combination with the square-shaped base, as defined by the pads 62, trap the guide 52 in the corner of the rulers.

Figure 3:
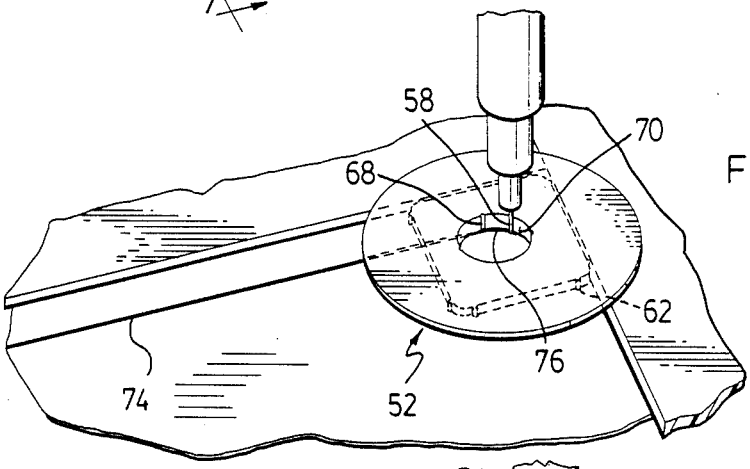

With reference to FIG. 3, a continued steady movement of the pen nib 58 causes the pen nib to leave the indentation 68 and follow the outline of the aperture internal edge guide portion 70 to provide for the continuous drawing of a curved corner portion 76 as the pen follows the outline of the aperture. During this continuous drawing of the curved corner, the guide 52 is trapped by the ruler edges 20 and 26 and precludes rotation of the guide. This ensures that the curved corner 76 is smoothly, uniformly drawn so as to provide a continuous appearance to the line as it rounds the corner to the position shown in FIG. 4, where the nib 58 rests in the next indentation 68. With the nib in this position, it is possible to move the guide 52 in the direction of arrow 78 to commence drawing of line 80 as the guide 52 moves along edge 20 of ruler 12.

Figure 4:
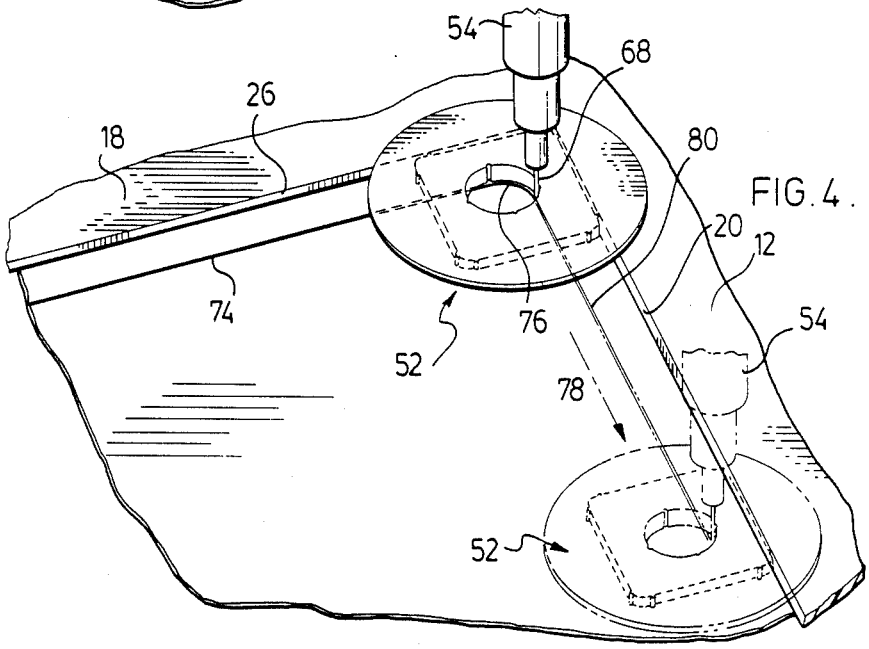

According to this invention and with reference to the particular embodiment discussed in FIGS. 2 through 4, straight border lines may be drawn as defined by edges 20 and 26 of the rulers 12 and 18 which are interconnected by a curved corner. By use of this apparatus, the straight line 74 smoothly and uniformly merges into a curved corner 76 which, in turn, smoothly and uniformly merges into straight line 80 without any variation in the width or positioning of the curved corner 76 and the straight lines. This is accomplished by trapping the guide 52 in the corner defined by the rulers, thereby forcing the drawing instrument to follow the outline of the guide internal edge of the guide 52 in forming the desired shape of the corner portion. The straight edges of the base, as they contact the rulers, provide stability for the guide to ensure uniformity in the straight lines of the border. Furthermore, in this manner, any desired shape for the guide portion 70 of the aperture in the guide 52 can be provided to give desired corner shape in the bordering, examples of which will be discussed with respect to FIGS. 9 and 10.

When it is desirable to use an ink pen to provide the border lines, it is necessary to ensure that the base portion 60 does not drag along the paper or drawing surface, since the fresh ink will be smeared or blotted by the base portion if it comes into contact with the ink. To ensure that this does not happen with ink drawings, a special construction of the guide with respect to the ruler edge is provided and demonstrated in FIGS. 6 and 7. The ruler 18, as with the other rulers 12, 14 and 16 of FIG. 1, includes an upper flat surface portion 82 along the edge 26. The flange 72 of the guide has an under surface 84 which rests on the flat surface 82 of the ruler 18. The base portion 60 is of a thickness less than the thickness of the ruler 18, thus with the flange 72 resting on the upper surface 82 of the ruler, the bottom 86 of the base portion 60 is spaced above the drawing surface 88 of the paper 90 or the like. Since FIG. 6 is drawn on an enlarged scale, the space indicated at 92 may be 5/1000 to 15/1000 of an inch, which is sufficient at indentation 68 to ensure that the bottom 86 of the base does not smear the ink drawn by the pen.

Figure 6:
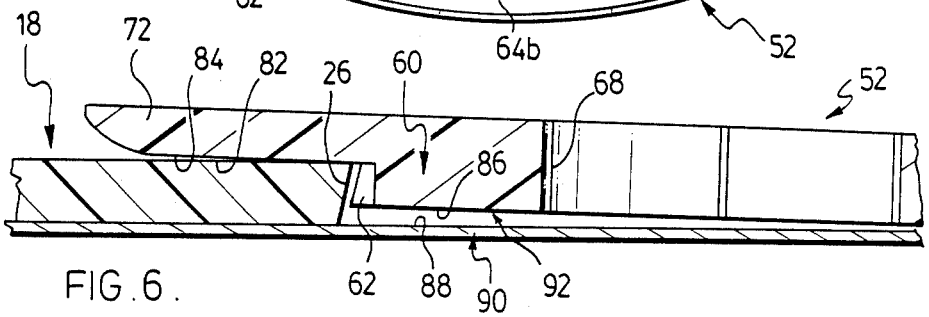
FIG. 6 is a section through the drawing instrument guide of FIG. 5 as it rests against a ruler edge.
Figure 7:
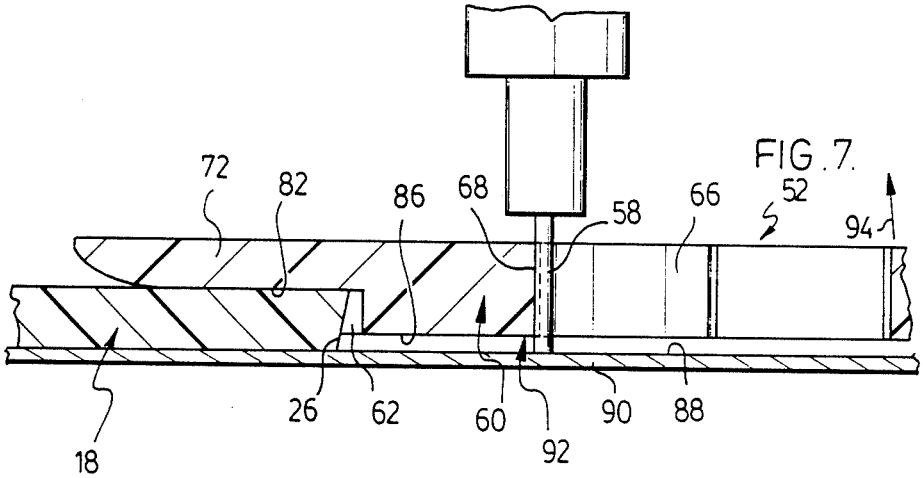
FIG. 7 is a section along the lines 7—7 of FIG. 2.

With the special relationship, as discussed with respect to FIG. 6, a pen nib 58 is pressed against the internal periphery edge 66 of the aperture 64 and as shown in FIG. 7, the nib 58 is located in an indentation 68. A slight pressure on the nib 58 presses the pads 62 against the edge 26 of the ruler 18. This causes an upward tilting of the guide 52 in the direction of arrow 94. This elevates the entire bottom 86 of the base 60 above the upper surface 88 of the paper 90 to ensure that the base does not smear or smudge the ink line being drawn by the pen nib 58. According to a preferred embodiment, the thickness of the base 60 relative to the height of the ruler 18 is such to provide a spacing in region 92 of approximately 5/1000 to 15/1000 of an inch. After the border lines are drawn, and it is thought that the ink is still not dry, the user may simply slide the guide 52 away from the ruler, because the flange 72 elevates the base lower portion 86 above the inked paper in the manner shown in FIG. 6. The base lower portion 86 is clear of the ink line before the flange 72 is slid off from the ruler.

The upward tilting of the guide is then accomplished by the pen nib pressing the pad 62 against the ruler edges, where the spacing between the base and the paper is maintained by the flange resting on the flat portion 82 of the ruler. To enhance the retention of the guide means along the ruler edge, the ruler edge may lie in a plane at an obtuse angle ranging from approximately 90° to 135° relative to the flat upper surface 82 of the ruler. According to a preferred embodiment shown in FIG. 7, the edge 26 lies in the plane which is approximately at an angle of 100° relative to the plane of the flat upper surface 82. This provides an undercut to the edge of the ruler which with a corresponding mating face provided on the pad 62, precludes the guide from flipping upwardly over the ruler edge by the interaction of the flange 72 of the upper surface 82 and the interaction of the pad incline with the undercut of the face of the ruler 26. Furthermore, by the mating engagement of the faces of the pad 62 and the ruler edge 26, the slight pressure applied by the pen nib in pressing the guide against the ruler edge ensures the upward tilting of the guide in the direction 94.

Figure 9:
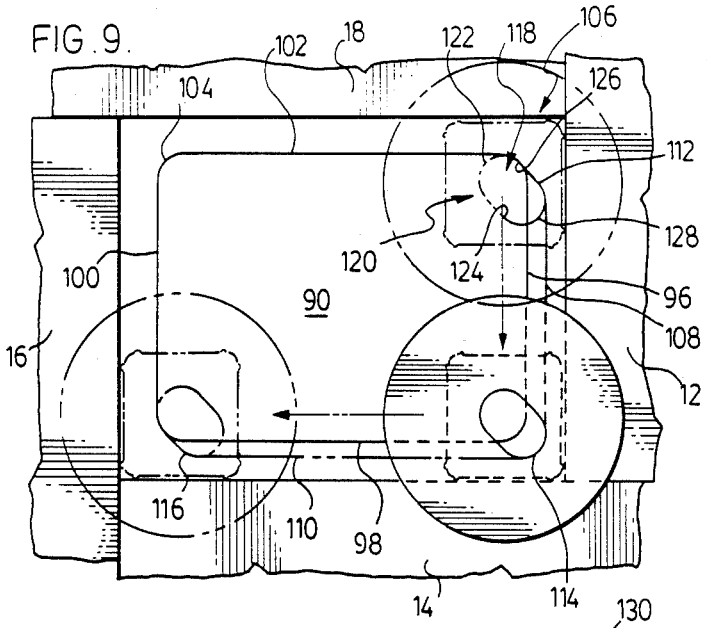
FIG. 9 is a top plan view showing the movement of an alternative embodiment for a drawing guide for producing a special line effect on two sides of a four-sided border.

In view of the guide being trapped in the corner defined by the rulers, thereby forcing a drawing instrument to follow the outline of the aperture in the base of the guide, various configurations of the corners of the border may be drawn. With reference to FIG. 9, the rulers 12, 14, 16 and 18 have been secured relative to the paper 90. On the paper, a border consisting of lines 96, 98, 100 and 102 with smoothly curved interconnecting rounded corners 104 has been drawn by use of a guide of the type discussed with respect to FIG. 2. In order to develop a three dimensional depth to the border already drawn, a second guide 106 may be used to draw the additional lines 108 and 110 with specially curved corners 112, 114 and 116. To provide for the specially shaped corners, an oblong aperture 118 is provided in the base 120 of the guide. The rounded portion 122 of the aperture 118 is of the same radius as the circular aperture used in drawing the rounded corners 104 of the pre-existing border. The aperture includes extended straight line portions 124 and 126 which merge into a rounded portion 128 to provide for the drawing of the lines 112, 116 and the specially curved portion 114 of the additional border lines.

With the guide device 106, according to this alternative embodiment, the pen may be placed along the appropriate section of aperture 118 such that as the guide is trapped in the three respective corners of the rulers, the corners 112, 114 and 116 are drawn as guided by the edge of the aperture.

Figure 10:
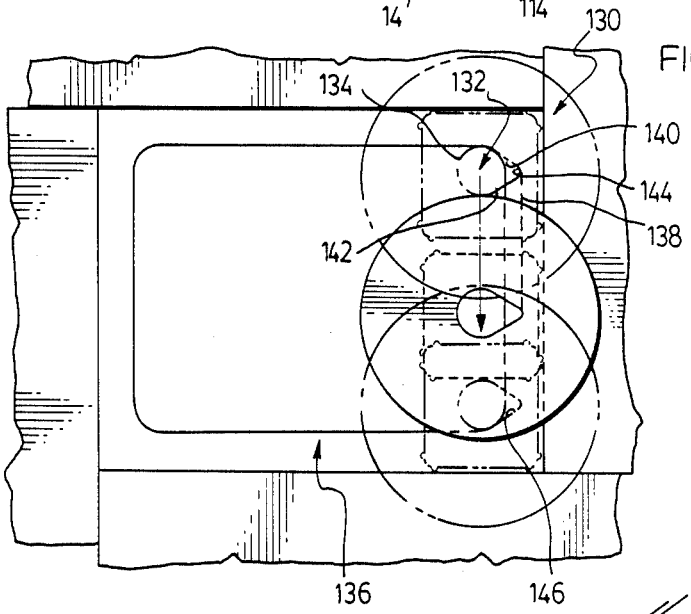
FIG. 10 is a top plan view of another embodiment for the drawing guide for creating a special effect along one side of a four line border.

According to another embodiment of the invention, as shown in FIG. 10, another type of guide 130 may be used having a lobed-shaped aperture 132. The curved portion 134 of the aperture has the same radius as the circular aperture based in drawing the pre-existing border generally indicated at 136. To provide for a depth along one edge of the border in drawing the additional line 138, the lobed-shaped edges 140 and 142 are used in drawing the curved corner portions 144 and 146. The guide 130, as it is trapped in both corners and moved from one corner to the other, causes the drawing instrument as it traverses the interior edge of the aperture 132 to provide the desired additional aspect to the pre-existing border line.

Figure 10B:
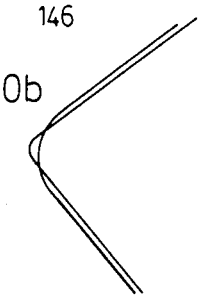
FIGS. 10*a* and 10*b* are plan views of special corner configurations for intersecting sets of border lines.
Figure 10A:
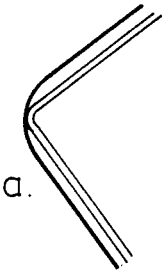

Other special effects may be created in the corners of the border. For example, plural border lines may cross or contact one another in the manner shown in FIGS. 10*a* and 10*b*. These effects are accomplished by the use of different sized guides of a series or sets of series of guides 52. By their interchangeable use, the asymmetrical relationship of the lines in the corners can be developed.

Figure 11:
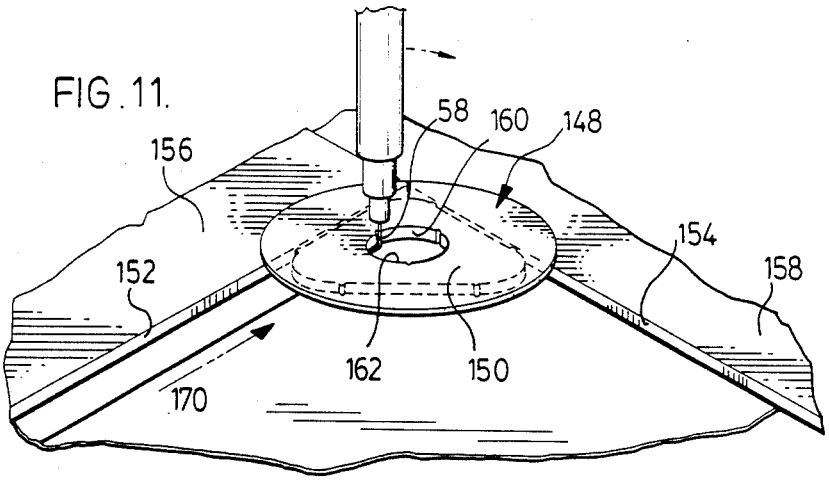
FIGS. 11 and 12 are perspective views showing the use of an alternative embodiment for the drawing guide used in triangular-shaped border drawing.
Figure 12:
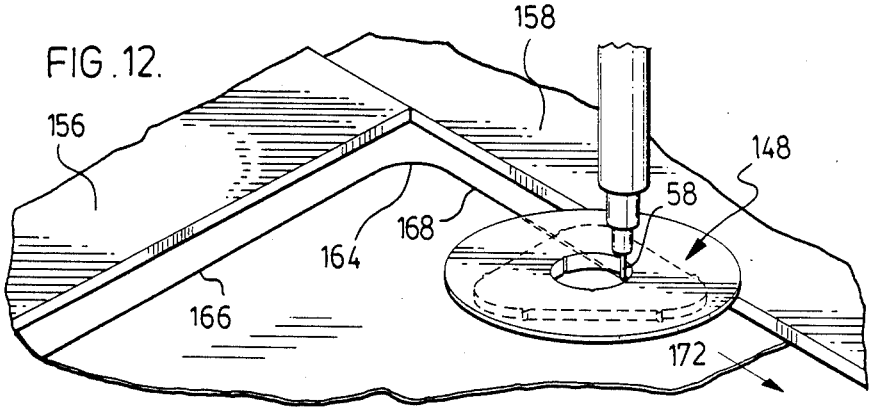

It is appreciated that the invention may be used in drawing other shapes of borders, such as the triangular-shaped borders represented in FIGS. 11 and 12. A guide 148 has a triangular-shaped base 150 which abuts the edges 152 and 154 of the rulers 156 and 158 which meet at an angle in the corner less than 90°. A preferred angle between the ruler edges is 60°. With the edges of the base portion 150 abutting both edges of the rulers, the guide is trapped thereby causing the pen nib 58 to traverse the guide portion 160 of the aperture 162 in the guide base. This permits the formation of a smoothly rounded corner at 164 between the intersecting first and second lines 166 and 168 as shown in FIG. 12, where the guide has been moved along the ruler edges in the directions of arrows 170 and 172 of FIGS. 11 and 12.

It can, therefore, be appreciated in view of the above discussion of the various embodiments of the invention that the guide device, according to this invention, can be designed in a variety of ways to provide for the continuous drawing of lines which may be straight or curved and intersect in any desired form of curved and angulated corner.

Figure 8:
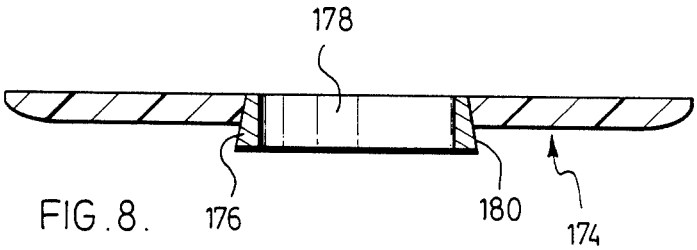
FIG. 8 is a section through an alternative embodiment for the drawing instrument guide.

It is further appreciated that the design for the base portion for the guide may be altered to a shape other than external edges which lie in planes. For example, the guide may include a base portion which is circular. As shown in the section of FIG. 8, the guide 174 has an annular base portion 176 within which a circular internal guide surface 178 is defined. The annular base portion 176 includes an external surface 180 which is sloped to the extent to matingly engage the slope of the edge of the ruler as discussed with respect to FIG. 7. With the drawing instrument placed in the aperture and against the guide surface 178, a straight line may be drawn along the edges of the ruler and when the base portion 176 engages both ruler edges by frictional engagement, rotation of the guide 174 is prevented as the pen follows the outline of the internal edge 178 to define a rounded corner between intersecting straight lines. By this frictional engagement of the base external edge with the pair of rulers, rotation of the guide is prevented during the continuous drawing of the corner portion.

Figure 13:
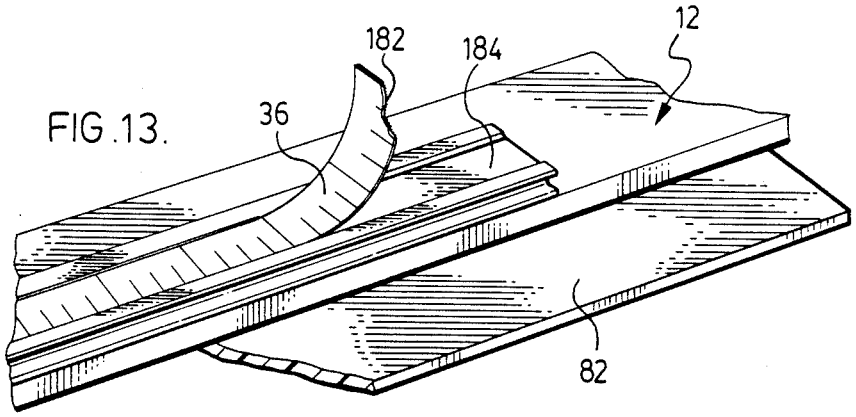
FIG. 13 is a perspective view of a portion of one of the rulers of FIG. 1.

In view of the variety of applications to which the drawing apparatus may be used, the scales which are placed on the top surface of the ruler may be removable and a different scale put in place. As shown in FIG. 13, the ruler 12 includes a removable scale 36 which may have pressure sensitive adhesive 182 on the back of the scale. The scale may be in inches, millimeters or picas. The scales can be readily replaced by stripping off the unwanted scale and removing different scale from a sheet of scales having pressure sensitive adhesive backings and placed in the recess 184 of the ruler to provide the desired new scale on the device.

Figure 14:
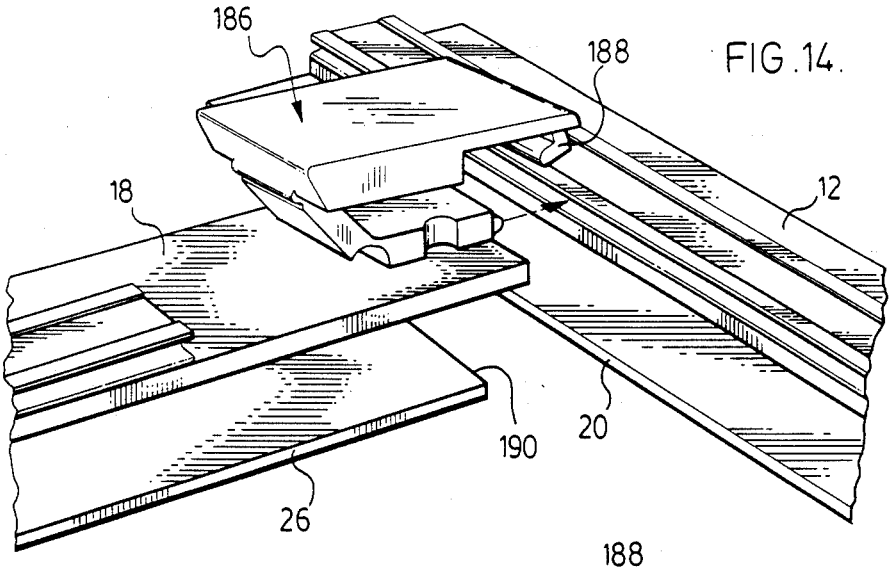
FIG. 14 is an exploded perspective view of the release connector for connecting two rules of the set of FIG. 1.
Figure 15:
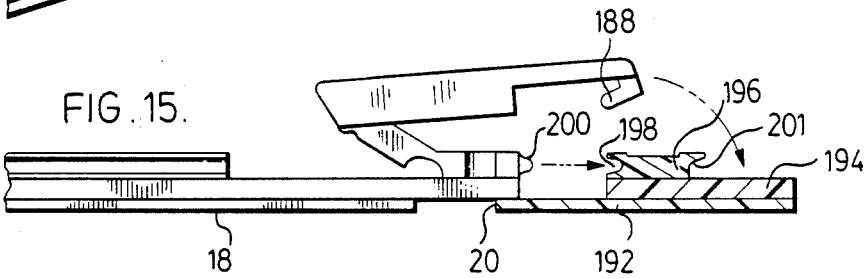
FIGS. 15, 16 and 17 are sections through the connector of FIG. 14 showing sequentially the releasable interconnection of one ruler to another.
Figure 16:
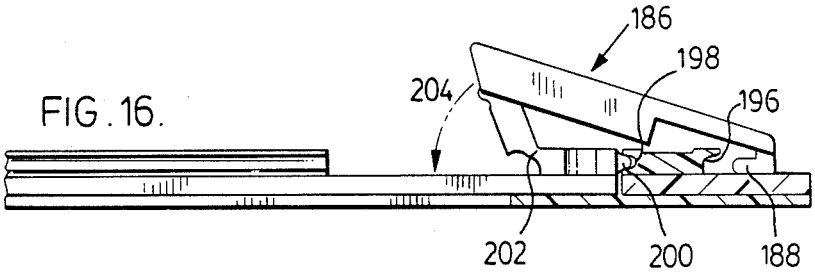
Figure 17:
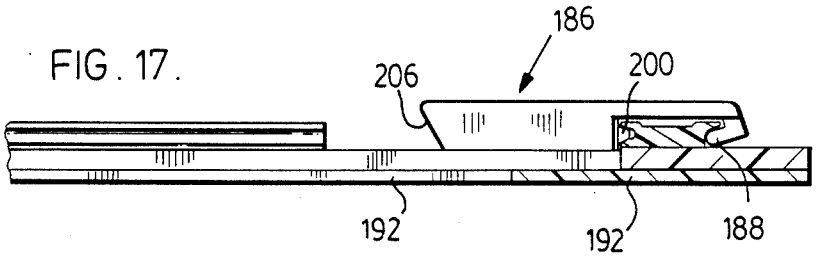

The releasable interconnection for the rulers of FIG. 1 provide for an adjustment of the size of the rectangular frame. As shown with respect to FIG. 14, a releasable connector 186 includes a hook 188 which grips one of the rulers 12 and draws it towards the other ruler 18 by closure of the connector 186. The angle at which the rulers intersect is determined by the abutting faces of ruler edge 20 and ruler end 190. Providing edge 190 is at 90° to ruler edge 26, then a rectangular frame is defined when all rulers are interconnected by the connector 186. Each ruler includes a base 192 which includes the edge 20 against which the base of the guide abuts. On top of the base 192 is a strengthening member 194 which is secured to the base 192. The scale carrying device 196 is mounted on top of the strengthening member 194. The scale carrying device 196 includes a recess 198 extending its length to receive the lug 200 of the connector. The hook 188 of the connector is received in the undercut 201 of the scale carrier. Ruler 18 is constructed in a similar manner such that with the releasable connector 186 positioned such that the lug 200 is in the recess 198 and the clip hinged upwardly about pivot point 202, the hook 188 is in position to be placed in undercut 196. A downward pressing of the clip 186 in the direction of arrow 204 results in drawing the hook 188 within the undercut 196 which brings the ruler edges together and forms a secure interconnection as shown in FIG. 17. When it is desired to release the connector, the undercut portion 206 of the connector allows one to place their finger underneath the clip and raise it to the position shown in FIG. 16. This permits movement of one ruler relative to the other such that the corresponding edge of the connector may be used as an indicator to locate the ruler edge relative to the other in the desired location. By selective releasing of the connectors, for example the connectors at diagonally opposed corners of the rectangular frame, a first set of rulers may be moved to expand or decrease the rectangular frame in one direction to the desired location. Those connectors are resecured. The other pair of connectors may then be released to provide for adjustment of the rectangular frame in the other direction. In this manner, an expedient adjustment for the rectangular frame size is provided by use of the type of connector discussed with respect to FIGS. 14 through 17.

Accordingly this invention provides a drawing apparatus of simple, inexpensive construction which provides for the reliable, uniform, continuous drawing of border lines. The additional feature of providing for a tilt of the guide means relative to the rulers ensures that the guide does not disturb the freshly applied ink in drawing the border lines. The preferred use of slight indentations in the guide surface of each guide assists in the use of the guides in moving them along the rulers, although it is understood that such indentations are not essential in the functioning and use of the drawing apparatus.

Although preferred embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. A drawing apparatus for guiding the continuous drawing of a line extending from a first direction around an interior corner of a selected shape toward a second direction, said apparatus comprising first and second rulers which intersect one another at a desired angle to thereby define an interior corner; a drawing instrument guide movable along said first ruler to said corner and movable along said second ruler from said corner; a guide interior edge defining an aperature through said guide for receiving a drawing instrument engaging said edge when the guide is moved along the first ruler toward said corner, when the guide is at said corner, and when the guide is moved along said second ruler away from said corner, the aperature receiving said instrument sufficiently loosely to permit translation of said instrument along said aperture edge and the segment of said edge engaged by the instrument when the guide is at said corner having said selected corner shape; and coacting means on said guide and said rulers for preventing rotation of the guide relative to each ruler with which it is engaged.

2. An apparatus of claim 1, wherein said base external edge comprises at least first and second portions which define two planes intersecting at an angle corresponding to said desired angle of intersection for said ruler pair, said base first and second external edge portions being trapped by abutting simultaneously said first and second edge portions of said ruler pair to prevent rotation of said guide during drawing of a curved corner from a first line merging into a second intersecting line.

3. An apparatus of claim 1, wherein said base external edge is circular which abuts and frictionally engages said first and second edge portions of said ruler pair to prevent rotation of said guide during drawing of a curved corner from a first line merging into a second intersecting line.

4. An apparatus of claim 3, wherein said aperture has a circular shaped internal edge.

5. An apparatus of claim 2 further comprising two pairs of rulers interconnected to define a rectangular frame having first, second, third and fourth edges, said frame having four 90° angle corners, said guide base being rectangular shaped to define four intersecting planes, said base rectangular edges being trapped at each frame corner to provide for continuously drawing four intersecting lines with interconnecting four curved corners.

6. An apparatus of claim 1, wherein said guide means has a flange portion extending outwardly beyond said base portion, each of said rules having a flat upper surface portion along its edge, said base portion having a thickness dimension slightly less than a thickness dimension for each of said rulers, said flange portion overlapping said flat portion of each said ruler during line drawing, said ruler edge providing a fulcrum about which said guide tilts to elevate said base portion off of a drawing surface when said base portion external edge engages either of said ruler edges and said flange contacts a corresponding said ruler flat portion to limit tilting of said guide due to a forcing of said base external edge against said ruler edge by a drawing instrument pressing against a corresponding one of said guide portions.

7. An apparatus of claim 6, wherein each of said first and second ruler edges lines in a plane which defines an obtuse angle relative to said flat upper surface in the range of 90° to 135°, said base portion external edge being shaped to provide for mating engagement with said first or second ruler edge when said guide means is tilted to elevate said base portion off of a drawing surface.

8. An apparatus of claim 7, wherein said base external edge which engages said first and second ruler edges is defined by spaced-apart pads which project from said base portion beneath said flange portion, said pads being shaped to provide for said mating engagement with said ruler edges.

9. An apparatus of claim 8, wherein said base portion has a rectangular shaped external edge defined by said pads, said rulers intersecting at 90° whereby said base portion upon engaging simultaneously first and second edges of said rulers traps said guide to preclude rotation of said guide means during continuous drawing of a curved corner leading from a first line and merging into a second line.

10. An apparatus of claim 9, wherein said aperture is circular.

11. An apparatus of claim 10, wherein a set of a plurality of guide means is provided, each guide means having a base portion with pads which lie in intersecting planes defining a square, said square-shaped arrangement for said pads being identical on each guide means of said set, said plurality of guide means of said set having serially increasing diameters for said apertures, each aperture being centered within said square for each said guide means.

12. An apparatus of claim 10, wherein said aperture includes an indentation on its internal surface at said first and third guide portions to receive a portion of a drawing instrument in guiding drawing in intersecting lines.

13. An apparatus of claim 8, wherein said base external edge defined by said pads is triangular-shaped of equilateral sides, said pair of rulers intersecting at a 60° angle.

14. An apparatus of claim 7, wherein said obtuse angle is in the range of 100° to 105°.

15. An apparatus of claim 5, wherein means releasably interconnects said two pair of rulers at their corners to provide for adjustment in size of rectangular frame defined by said first, second, third and fourth edges.

16. An apparatus of claim 13, wherein said interconnecting means at each corner of said frame includes an indicator for indicating a sealed location of a corresponding said ruler edge relative to an opposite said ruler edge on a scale provided on a third said ruler interconnecting said opposite rulers.

17. An apparatus of claim 12, wherein each of said indentations is approximately 0.002 inches deep.

* * * * *